US005245387A

United States Patent [19]

Kubo et al.

[11] Patent Number: 5,245,387

[45] Date of Patent: Sep. 14, 1993

[54] ELECTROPHOTOGRAPHIC APPARATUS WITH REDUCED CONTAMINATION FROM TONER SCATTERING

[75] Inventors: Takashi Kubo; Koichi Moriyama, both of Yamatokoriyama; Yoshiaki Masuda; Hidetoshi Kaneko, both of Nara; Yasutaka Maeda, Ikoma; Hiroshi Kawamoto, Nara, all of Japan

[73] Assignee: Sharp Kabushiki Kaisha, Osaka, Japan

[21] Appl. No.: 829,460

[22] Filed: Jan. 31, 1992

[30] Foreign Application Priority Data

Feb. 1, 1991 [JP] Japan ..... 3-12001
Sep. 4, 1991 [JP] Japan ..... 3-223914

[51] Int. Cl.[5] ..... G03G 15/01; G03G 21/00

[52] U.S. Cl. ..... 355/239; 355/327; 355/71

[58] Field of Search ..... 355/239, 327, 328, 71, 355/66, 215

[56] References Cited

U.S. PATENT DOCUMENTS

| | | | |
|---|---|---|---|
| 3,120,790 | 2/1964 | Carlson et al. . | |
| 3,815,991 | 6/1974 | Janssen et al. | 355/66 |
| 3,844,653 | 10/1974 | Kelly | 355/66 X |
| 3,958,877 | 5/1976 | Menon et al. . | |
| 3,961,848 | 6/1976 | Turner . | |
| 3,987,756 | 10/1976 | Katayama et al. . | |
| 4,003,649 | 1/1977 | Goren et al. . | |
| 4,007,981 | 2/1977 | Goren . | |
| 4,025,181 | 5/1977 | Menon et al. . | |
| 4,066,353 | 1/1978 | Bobbe . | |
| 4,090,786 | 5/1978 | Bobbe . | |
| 4,095,889 | 6/1978 | Goren . | |
| 4,227,795 | 10/1980 | Bobbe . | |
| 4,657,377 | 4/1987 | Takahashi . | |

*Primary Examiner*—R. L. Moses
*Attorney, Agent, or Firm*—David G. Conlin; Geroge W. Neuner

[57] ABSTRACT

The present invention provides a compact electrophotographic device in which the gap between a screen and a photosensitive body can be kept uniform throughout the screen, no fogging is caused on a copied imaged, no wasteful space is around the photosensitive body, color contaminations are completely prevented and the quality of a color copied image is improved.

4 Claims, 4 Drawing Sheets

ELECTROPHOTOGRAPHIC APPARATUS WITH REDUCED CONTAMINATION FROM TONER SCATTERING

BACKGROUND OF THE INVENTION

1. Field of the Invention

The present invention relates to an electrophotographic device such as a copying machine of the electrophotographic system equipped with an exposure optical system for transmitting a light reflected on an original to a photosensitive body and a screen filter disposed on the optical path for dividing the light exposing the photosensitive body linearly.

2. Description of the Prior Art

The screen process has been known as a method for improving gradation of an image in a copying machine of the electrophotographic system. In this process, a screen on which light transmitting portions and light non-transmitting portions in the shape of strips are alternately formed is provided near a photosensitive body. A light reflected on an original, which is divided linearly by the screen, is emitted onto the photosensitive body for exposure. Thus the copied image is given gradation in accordance with the width of the strips on the screen.

In this process, an accuracy of the gap between the screen and the photosensitive body must be very precise. This process is effective since a shadow of the screen on the photosensitive body can be wide or narrow, depending upon the quantity of light for image exposure. Therefore, it is very important to keep the gap from the photosensitive body with an accuracy of 0.2 mm or less.

Moreover, these pitches on the screen are revealed on the copied image, therefore, it is necessary to make the pitches typically 120 lines/inch or less in order to make them unnoticeable. The width of the light transmitting portions, which depends upon the distance from the photosensitive body, is most preferably 50 to 70 μm and the gap is most preferably 0.8 to 1.5 mm.

A film with a thickness of about 100 μm made by the electrophotographic system is generally used as the screen because it requires a precise accuracy in both the width and the pitch.

The above-mentioned screen is mounted with a strong tension in the transverse direction of the copying machine with its screen surface opposite the surface of the photosensitive body below so as to maintain the gap from the photosensitive body. Moreover, a device and the like to strengthen the ends of the film and to transfer the tension equally in all directions is provided so that a strong force can be given to the film of a material with small tear resistance.

However, in the above-mentioned disposition, it is disadvantageously difficult to keep uniform the gap from the surface of the photosensitive body, since the center portion of the screen in the transverse direction of the copying machine tends yield due to its own weight. Thus the gap in the center portion is narrower than those in the end portions, thereby causing a problem of a fogging in the copied image, that is, a phenomenon that toner sticks to a portion of the copying paper which must remain white.

FIG. 5 shows a conventional color copying machine of the electrophotographic system. In the movable area of a photosensitive belt 70 shown by an arrow B, a yellow developing vessel 40, a magenta developing vessel 50, a cyanogen developing vessel 60 and a black developing vessel 30 are provided adjacent in this order from the upstream of the movement of the belt. In this color copying machine, an original on a placing table is scanned by an optical system 200 three times. At each time a light reflected on the original is slit exposed through a color separation filter onto the photosensitive belt 70. Thus electrostatic latent images are formed in complementary colors of yellow, magenta and cyanogen. Every time an electrostatic latent image is formed, yellow toner, magenta toner and cyanogen toner are respectively supplied in this order from the yellow developing vessel 40, the magenta developing vessel 50 and the cyan developing vessel 60, thereby superimposing these images on a transfer belt 100 which is pressure welded to the photosensitive belt 70.

After superimposing, a copying paper is transferred from a paper cassette 80 to a transfer roller 220, where a toner image is transferred onto the copying paper. The image on the copying paper after the transferring process is fixed by a fixing device and then fed out of the copying machine.

In the case of monochrome copying, only black toner in the black developing vessel 30 is used.

The developing device in which the developing vessels are provided adjacent as above has a shortcoming in that color contamination tends to be caused by scattered toner from the black developing vessel 30 in the yellow developing vessel 40 the magenta developing vessel 50 and especially the cyan developing vessel 60 which is next to the black developing vessel 30. The color contamination area is shown by a reference P in FIG. 5.

The color contamination reduces the color reproduction in color copying, thereby spoiling the quality of the image, which will be a dark cloudy image as a whole.

Additionally, when each of the developing vessels is provided on the same side of the photosensitive belt 70, it is difficult to mount all the developing vessels in a predetermined space as the required mounting space is too large. The same problem occurs also in a color copying machine utilizing a photosensitive drum as a photosensitive body.

Such a problem in, for example, a color copying machine utilizing a photosensitive drum, can be solved by making the diameter of the photosensitive drum large enough to make the space around the drum also large. Then it is possible to secure the mounting space of the developing vessels. However, this causes another problem that the color copying machine itself becomes large-sized.

On the other hand, small developing vessels are advantageous in the mounting space but cause other problems such as slow developing speed, short life time of developers and reduced developing performance.

Due to the above-mentioned reasons, it is desired to realize a compact copying machine in which developing vessels are effectively mounted without wasteful space.

SUMMARY OF THE INVENTION

The electrophotographic device of this invention, which overcomes the above-discussed and numerous other disadvantages and deficiencies of the prior art, comprises an exposure optical system for transmitting a reflected light from an original to a photosensitive body and a screen filter disposed on the exposing optical path to divide the light exposing the photosensitive body linearly, wherein reflecting mirrors in the optical system are disposed so that the light can be emitted to the photosensitive body horizontally and the screen filter is disposed near the photosensitive body with its screen surface horizontal.

In a preferred embodiment, the screen filter has positioning rollers which are pressure welded to the photosensitive body and adjust a gap between the screen filter and the photosensitive body.

In a preferred embodiment, the electrophotographic device comprises a developing device to supply toner to a portion on the photosensitive body exposed through the screen filter, the developing device comprises color developing vessels including a yellow developing vessel, a magenta developing vessel and a cyanogen developing vessel and a black developing vessel for monochrome copying, and the color developing vessels are disposed opposite the black developing vessel with the photosensitive body therebetween.

Thus, the invention described herein makes possible the objectives of providing (1) an electrophotographic device in which a gap between a screen and a photosensitive body is kept uniform throughout the screen, thereby preventing a fogging in a copied image, (2) an electrophotographic device which can make a whole copying machine compact without any wasteful space around the photosensitive body, (3) an electrophotographic device in which a screen is effectively mounted and (4) an electrphotographic device in which color contaminations can be completely prevented, thereby improving the quality of a color copied image.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

The example of the present invention will now be described.

Figure 1:
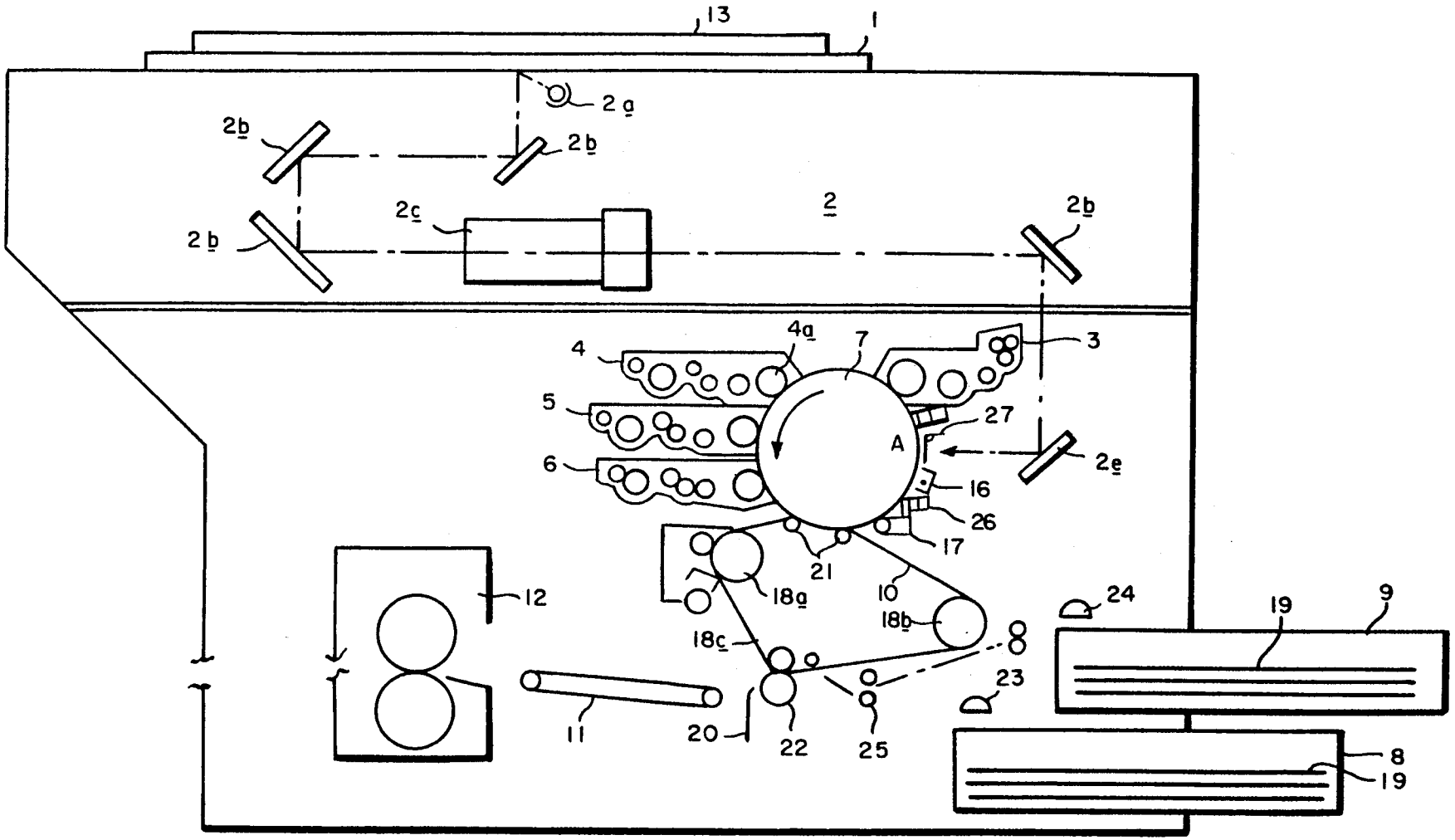
FIG. 1 is a front sectional view of a color copying machine in accordance with the present invention.

FIG. 1 shows a color copying machine according to the present invention. A placing table 1 made of a transparent glass is provided on the upper surface of the color copying machine. An exposure optical system 2 is disposed below the placing table 1. The exposure optical system 2 includes an illuminant lamp 2*a* which irradiates an original 13 on the placing table I, a plurality of reflecting mirrors 2*b* and 2*e* to transmit the reflecting light from the original 13 to a photosensitive drum 7, for example, as shown by a dashed line in the drawing, an image forming lens 2*c* disposed on the optical path and a color separation filter 2*d* having color filters of three primary colors, red, green and blue.

The photosensitive drum 7, which is formed by providing the surface of the drum, made for example from aluminum, with an organic photosensitive corpus (OPC), is disposed rotatably counterclockwise, in the direction shown by an arrow A, approximately in the center of the color copying machine. The reflecting mirror 2*e*, which is the last step of the exposure optical system 2, is disposed sideward of the photosensitive drum 7, thereby allowing the exposed scanned light image to finally emit horizontally onto the photosensitive drum 7. Furthermore, near the photosensitive drum 7 on the optical axis is provided a screen filter 27, through which the light image is emitted onto the photosensitive drum 7.

Figure 2A:
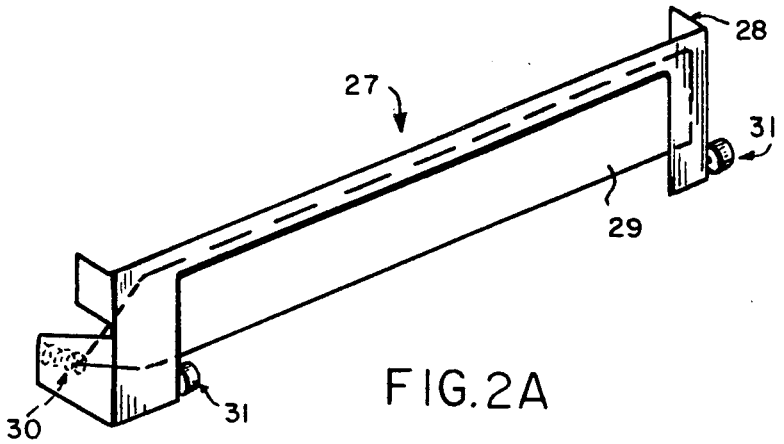
FIG. 2A is a schematic perspective view of a screen filter used in the color copying machine in accordance with the present invention.

FIG. 2A shows the screen filter 27 in detail. The screen filter 27 is formed by providing an outer frame 28 in the channel status seen from the front with a screen 29 in a rectangular shape. One end of the screen 29 is combined with a spring 30 to give a tension thereto so as to mount the screen 29 on the screen filter 27 with tension.

Figure 2B:
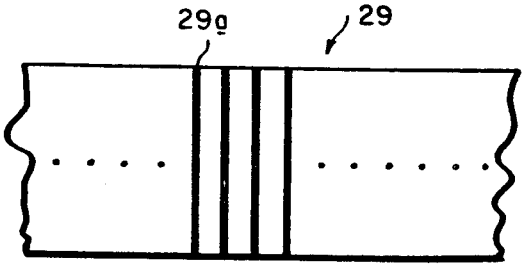
FIG. 2B is a partially enlarged diagram of the screen used in the screen filter.

A plurality of linear light non-transmitting portions 29*a* are formed on the screen 29 as shown in FIG. 2B. A pair of rollers 31 are provided on the outer frame 28 of the screen filter 27 for the purpose of positioning the screen 29 against the photosensitive drum 7. The screen filter 27 is disposed near the photosensitive drum 7 with these rollers 31 pressure welded to the photosensitive drum 7, thereby keeping the gap between the screen 29 and the photosensitive drum 7 at a predetermined distance by the rollers 31.

In the described example, the width and the pitch of the light non-transmitting portion 29*a* are set to be 63 μm and 120 lines/inch, respectively, the thickness of the screen filter 27 is 100 μm and the gap between the screen 29 and the photosensitive drum 7 is 1.5 mm.

Figure 3:
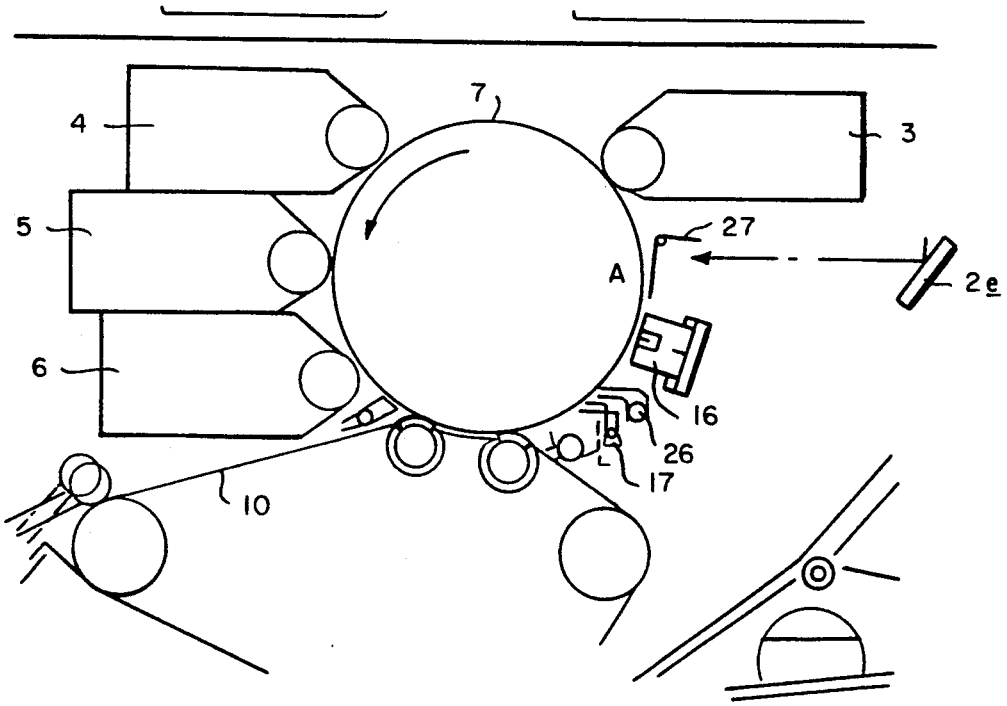
FIG. 3 is an enlarged front diagrammatic view around a photosensitive drum.

A black developing vessel 3 for monochrome copying is disposed right upward of the photosensitive drum 7, that is, above the screen filter 27, without touching the photosensitive drum 7. On the other side of the photosensitive drum 7 opposing to the black developing vessel 3, a yellow developing vessel 4, a magenta developing vessel 5 and a cyanogen developing vessel 6 for color copying are disposed independently. Each of the developing vessels 4, 5 and 6 contain color developers of yellow, magenta and cyan, respectively. This structure is shown in FIG. 3, which is an enlarged diagram around the photosensitive drum 7.

A couple of paper cassettes 8 and 9 containing copying papers 19 with desired sizes, respectively, are disposed upstream of the paper feeding direction, that is, on the right side of the photosensitive drum 7 in FIG. 1. These cassettes 8 and 9 are provided with paper feeding rollers 23 and 24 above the front ends of the cassettes 8 and 9, respectively, for feeding copying papers 19 in the cassettes. A copying paper 19 fed from the cassette 8 or 9 is conveyed toward a transferring belt (an intermediate transfer) 10 disposed rotatably below the photosensitive drum 7.

The paper is conveyed by a timing roller 25 rotating synchronously with the rotation of the transfer belt 10, which is rotated by a first roller 18*a*, a second roller 18*b* and a third roller 18*c*.

In addition, an electrification charger 16 which electrifies the surface of the photosensitive drum 7 uniformly prior to the exposure from the optical system 2 and a discharge lamp 26 which discharges the surface of the photosensitive drum 7 after copying are disposed around the photosensitive drum 7. Furthermore, a cleaning device 17 for eliminating toner remained on the photosensitive drum 7 after copying is provided below the photosensitive drum 7 near the electrification charger 16.

The copying operation in the color copying machine with the above-mentioned structure will now be described.

When a start switch (not shown) is turned on by an operator, a copying mode is performed. The copying mode includes copying cycles in which toner images are developed with yellow, magenta and cyan toner respectively on the photosensitive drum and transferred onto the transfer belt 10. When a copying mode is performed, a copying cycle using yellow toner is first carried out as follows:

The original 13 on the placing table 1 is irradiated by the illuminant lamp 2*a* and scanned. The light reflected on the original 13 goes through the reflecting mirrors 2*b* and the image forming lens 2*c* into the color separation filter 2*d*, where the light is separated into each color.

The separated light having transmitted through each color filter in the color separation filter 2*d* is reflected by the reflecting mirror 2*e*, passes under the black developing vessel 3 and then enters the screen filter 27 horizontally. Then the light is divided linearly by the screen filter 27 and is emitted onto the photosensitive drum 7 which is electrified uniformly by the electrification charger 16 prior to the exposure. Thus, the portion shown by a reference A on the photosensitive drum 7 is exposed.

In this way an electrostatic latent image with the color yellow is formed on the exposed portion of the photosensitive drum 7 in response to the image on the original 13. The electrostatic latent image is then developed by the developer supplied by a developing magnet roller 4*a* at the opposing portion of the yellow developing vessel 4 containing yellow toner, the color of which is a complementary color of the color separation filter 2*d*. The latent image is thus visualized into a toner image, which is transferred onto the transfer belt 10 by a transfer charger 21.

After finishing the above-described yellow copying cycle, the photosensitive drum 7 is cleaned by the cleaning device 17 and discharged by the discharge lamp 26. Then the same procedures of copying cycles with colors of magenta and cyan are respectively repeated and toner images of magenta and cyan are also transferred onto the transfer belt 10.

When these copying cycles with each color are finished, the toner images with each color are transferred onto the same position on the transfer belt 10 by the transfer charger 21. These toner images with each color are superimposed, thereby forming one complete toner image.

A copying paper 19 contained in the paper cassette 8 or 9 is fed to the timing roller 25 one by one by the paper feeding roller 23 or 24. The timing roller 25 conveys the paper between the transfer belt 10 and a transfer roller 22 synchronously with the rotation of the transfer belt 10. After transferring the toner image on the transfer belt 10 onto the paper 19 by the transfer roller 22, the paper 19 is separated from the transfer belt 10 by a separation plate 20 and then fed to the fixing device 12 by a convey belt 11. Then a color toner image is fixed on the paper 19 by the fixing device 12 and the paper is conveyed out of the copying machine. In this way, one copying mode is finished.

The disposition of the optical system 2 and the screen filter 27 as above enables the light reflected on the original 13 to enter the photosensitive drum 7 horizontally through the screen 29 of the screen filter 27 via the reflecting mirrors 2*b* and 2*e*. Therefore, the gradation of the image can be improved by dividing the light linearly by the screen 29. Since the screen filter 27 is disposed with the surface of the screen 29 vertical, the center portion of the screen 29 is not yielded by the weight of the screen 29.

The above-described structure enables the gap between the surfaces of the photosensitive drum 7 and the screen 29 to be kept uniform throughout the screen 29. Therefore, no fogging due to an unequal gap occurs, which improves the quality of copied images.

Figure 4:
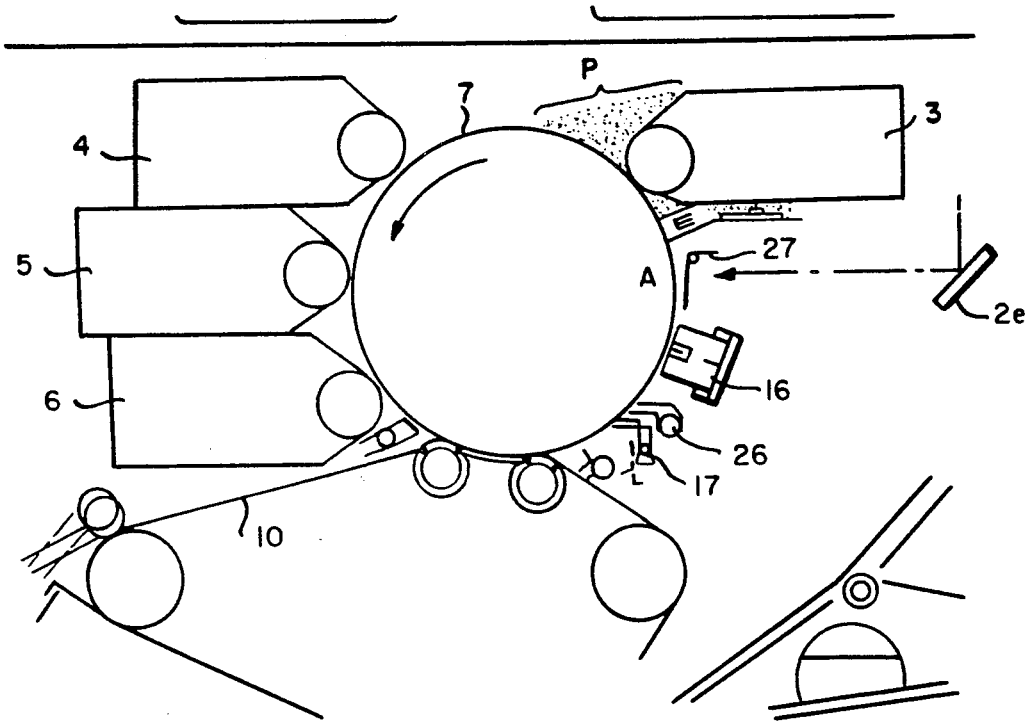
FIG. 4 is a front diagrammatic view showing the condition when black toner is scattered from a black developing vessel.
Figure 5:
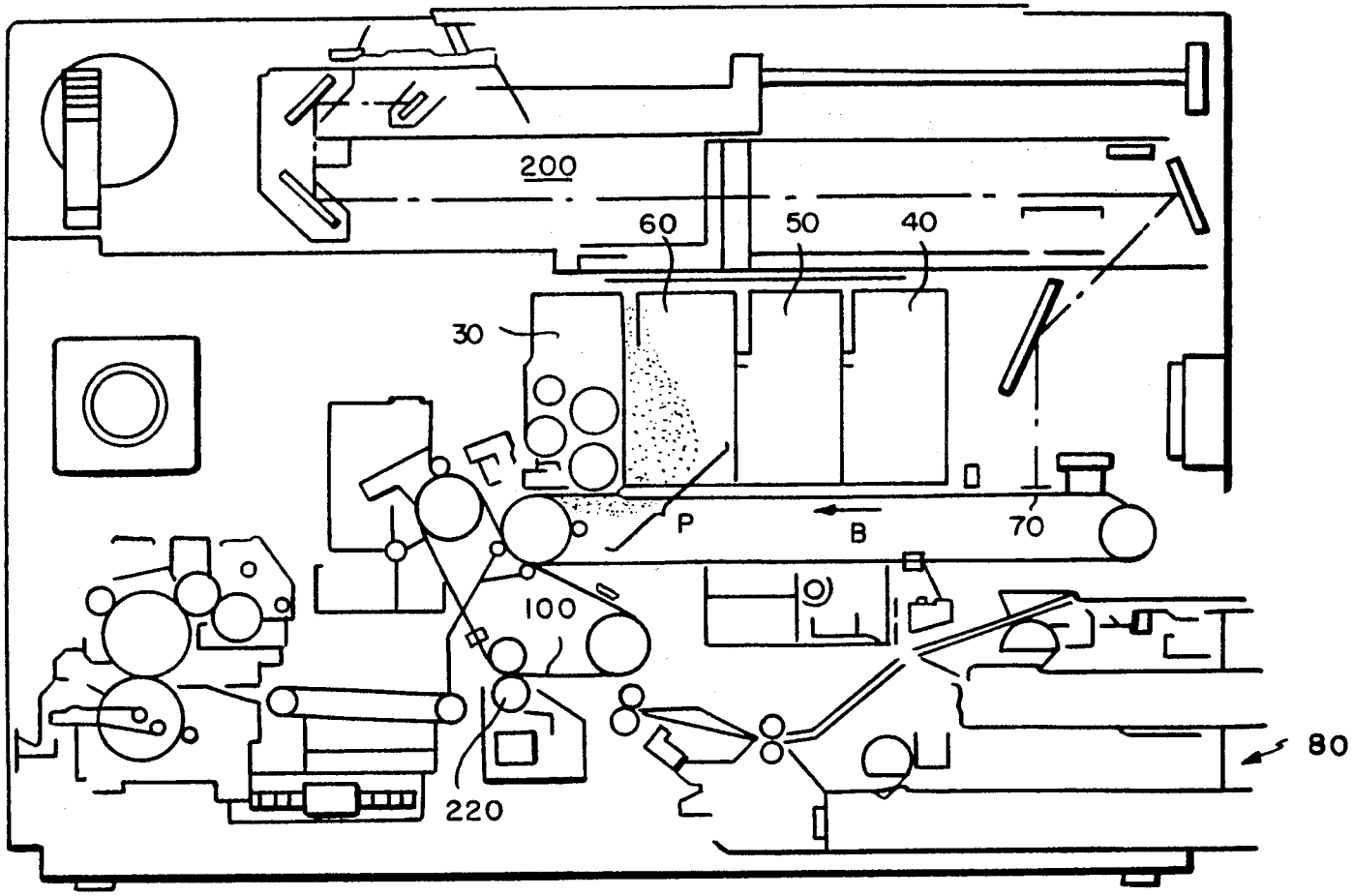
FIG. 5 is a front sectional view of a example of a conventional color copying machine.

The above mentioned disposition of the developing vessels of each color prevents the color contamination in yellow, magenta and cyan developing vessels caused by black toner scattered from the black developing vessel 3. Black toner scatters as shown by a reference P in FIG. 4. According to the present invention, the black developing vessel 3 is provided opposing to the other developing vessels 4, 5, and 6 on the opposite side of the photosensitive drum 7, which blocks the scattered black toner. Furthermore, the distance between these three vessels and the black developing vessel 3 is large enough for the black toner scattering area P to reach the other three developing vessels.

Moreover, the opposing disposition of the three color developing vessels and the black developing vessel enables the whole optical system 2 to be provided above the developing vessels because the developing vessels can be disposed horizontally around the upper part of the photosensitive drum 7. Accordingly, there is no wasteful space around the photosensitive drum 7, which is advantageous for producing a compact color copying machine.

Additionally, since the developing vessels are disposed as above and the light is exposed horizontally onto the photosensitive drum 7, the screen filter 27 is naturally mounted with the surface of the screen 29 vertical. Thus, the two objectives of preventing fogging and obtaining a compact color copying machine are achieved at the same time.

In this example, the present invention applied to a color copying machine equipped with a photosensitive drum is described, however, the invention can be also applied to a color copying machine equipped with a photosensitive belt.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An electrophotographic device comprising an exposure optical system for transmitting a reflected light from an original to a photosensitive body, a toner vessel disposed near the photosensitive body, and a screen means disposed on the exposing optical path to divide the light exposing the photosensitive body linearly, wherein reflecting mirrors in the optical system are disposed so that the light can be emitted to the photosensitive body horizontally and the screen means with its screen surface vertical is disposed near the photosensitive body and below the toner vessel, thereby reducing contamination on the screen surface.

2. An electrophotographic device according to claim 1, wherein the screen means has positioning rollers which are pressure welded to the photosensitive body and adjust the gap between the screen means and the photosensitive body.

3. An electrophotographic device comprising an exposure optical system for transmitting a reflected light from an original to a photosensitive body and a screen means disposed on the exposing optical path to divide the light exposing the photosensitive body linearly, wherein reflecting mirrors in the optical system are disposed so that the light can be emitted to the photosensitive body horizontally and the screen means with its screen surface vertical is disposed near the photosensitive body and a developing device to supply toner to a portion on the photosensitive body exposed through the screen means, the developing device comprising color developing vessels including a yellow developing vessel, a magenta developing vessel and a cyan developing vessel and a black developing vessel for monochrome copying, the color developing vessels being disposed opposing to the black developing vessel with the photosensitive body therebetween.

4. An electrophotographic device comprising an exposure optical system for transmitting a reflected light from an original to a side of a photosensitive body and a developing device to supply toner to a portion on the photosensitive body exposed through a screen means, the developing device including a black developing vessel for monochrome copying disposed adjacent the portion exposed by the reflected light and color developing vessels disposed opposite to the black developing vessel with the photosensitive body interposed therebetween.

* * * * *

UNITED STATES PATENT AND TRADEMARK OFFICE

CERTIFICATE OF CORRECTION

PATENT NO. : 5,245,387

DATED : September 14, 1993

INVENTOR(S) : T. Kubo, et al

It is certified that error appears in the above-indentified patent and that said Letters Patent is hereby corrected as shown below:

The title page should be deleted to appear as per attached title page.

In the drawings Figures 1 and 2B should be deleted to be replaced with the corrected Figures 1 and 2B as shown on the attached pages.

Signed and Sealed this

Twenty-sixth Day of April, 1994

*Attest:*

*Attesting Officer*

BRUCE LEHMAN

*Commissioner of Patents and Trademarks*

United States Patent [19]

Kubo et al.

[11] Patent Number: 5,245,387

[45] Date of Patent: Sep. 14, 1993

[54] ELECTROPHOTOGRAPHIC APPARATUS WITH REDUCED CONTAMINATION FROM TONER SCATTERING

[75] Inventors: Takashi Kubo; Koichi Moriyama, both of Yamatokoriyama; Yoshiaki Masuda; Hidetoshi Kaneko, both of Nara; Yasutaka Maeda, Ikoma; Hiroshi Kawamoto, Nara, all of Japan

[73] Assignee: Sharp Kabushiki Kaisha, Osaka, Japan

[21] Appl. No.: 829,460

[22] Filed: Jan. 31, 1992

[30] Foreign Application Priority Data

Feb. 1, 1991 [JP] Japan ..... 3-12001
Sep. 4, 1991 [JP] Japan ..... 3-223914

[51] Int. Cl.[5] ..... G03G 15/01; G03G 21/00

[52] U.S. Cl. ..... 355/239; 355/327; 355/71

[58] Field of Search ..... 355/239, 327, 328, 71, 355/66, 215

[56] References Cited

U.S. PATENT DOCUMENTS

| | | | |
|---|---|---|---|
| 3,120,790 | 2/1964 | Carlson et al. . | |
| 3,815,991 | 6/1974 | Janssen et al. | 355/66 |
| 3,844,653 | 10/1974 | Kelly | 355/66 X |
| 3,958,877 | 5/1976 | Menon et al. . | |
| 3,961,848 | 6/1976 | Turner . | |
| 3,987,756 | 10/1976 | Katayama et al. . | |
| 4,003,649 | 1/1977 | Goren et al. . | |
| 4,007,981 | 2/1977 | Goren . | |
| 4,025,181 | 5/1977 | Menon et al. . | |
| 4,066,353 | 1/1978 | Bobbe . | |
| 4,090,786 | 5/1978 | Bobbe . | |
| 4,095,889 | 6/1978 | Goren . | |
| 4,227,795 | 10/1980 | Bobbe . | |
| 4,657,377 | 4/1987 | Takahashi . | |

*Primary Examiner*—R. L. Moses

*Attorney, Agent, or Firm*—David G. Conlin; Geroge W. Neuner

[57] ABSTRACT

The present invention provides a compact electrophotographic device in which the gap between a screen and a photosensitive body can be kept uniform throughout the screen, no fogging is caused on a copied imaged, no wasteful space is around the photosensitive body, color contaminations are completely prevented and the quality of a color copied image is improved.

4 Claims, 4 Drawing Sheets

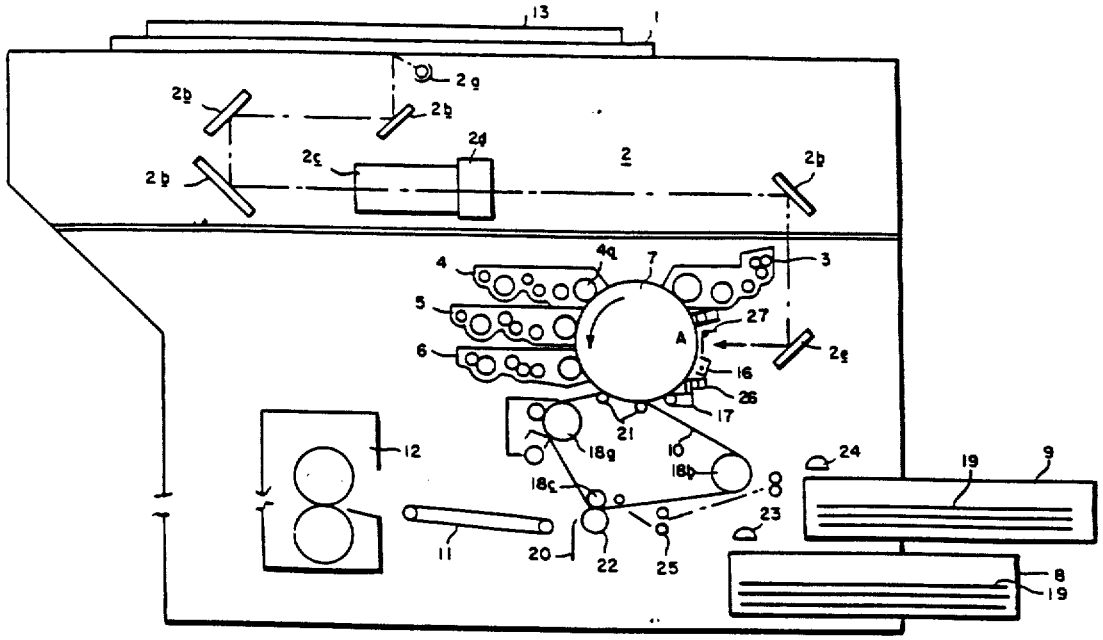

UNITED STATES PATENT AND TRADEMARK OFFICE

CERTIFICATE OF CORRECTION

PATENT NO. : 5,245,387

DATED : September 14, 1993

INVENTOR(S) : T. Kubo, et al

It is certified that error appears in the above-indentified patent and that said Letters Patent is hereby corrected as shown below:

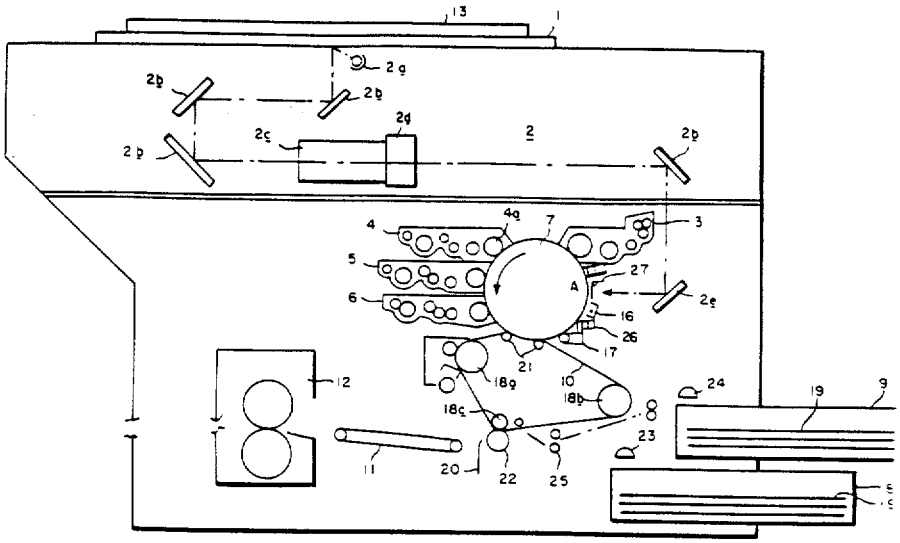

FIG.1

UNITED STATES PATENT AND TRADEMARK OFFICE

CERTIFICATE OF CORRECTION

PATENT NO. : 5,245,387

DATED : September 14, 1993

INVENTOR(S) : T. Kubo, et al

It is certified that error appears in the above-indentified patent and that said Letters Patent is hereby corrected as shown below:

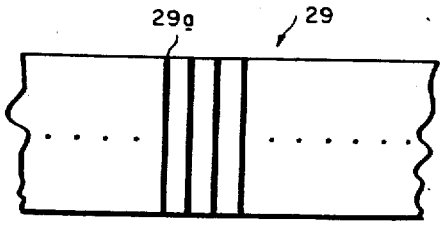

FIG. 2B

UNITED STATES PATENT AND TRADEMARK OFFICE

CERTIFICATE OF CORRECTION

PATENT NO. : 5,245,387

DATED : September 14, 1993

INVENTOR(S) : T. Kubo, et al.

It is certified that error appears in the above-identified patent and that said Letters Patent is hereby corrected as shown below:

| | |
|---|---|
| Column 1, line 68, | replace "cyanogen" with --cyan-- |
| Column 2, lines 8-9, | replace "cyanogen" with --cyan-- |
| Column 2, line 10, | replace "cyanogen" with --cyan-- |
| Column 3, line 14, | replace "cyanogen" with --cyan-- |
| Column 4, line 43, | replace "cyanogen" with --cyan-- |

Signed and Sealed this

Twentieth Day of September, 1994

*Attest:*

Bruce Lehman

BRUCE LEHMAN

*Attesting Officer*

*Commissioner of Patents and Trademarks*